US009015051B2

(12) United States Patent
Pulkki

(10) Patent No.: US 9,015,051 B2
(45) Date of Patent: Apr. 21, 2015

(54) RECONSTRUCTION OF AUDIO CHANNELS WITH DIRECTION PARAMETERS INDICATING DIRECTION OF ORIGIN

(75) Inventor: Ville Pulkki, Espoo (FI)

(73) Assignee: Fraunhofer-Gesellschaft zur Foerderung der angewandten Forschung e.V., Munich (DE)

( * ) Notice: Subject to any disclaimer, the term of this patent is extended or adjusted under 35 U.S.C. 154(b) by 1189 days.

(21) Appl. No.: 12/532,401

(22) PCT Filed: Feb. 1, 2008

(86) PCT No.: PCT/EP2008/000829

§ 371 (c)(1),
(2), (4) Date: Mar. 5, 2010

(87) PCT Pub. No.: WO2008/113427

PCT Pub. Date: Sep. 25, 2008

(65) Prior Publication Data

US 2010/0169103 A1 Jul. 1, 2010

Related U.S. Application Data

(63) Continuation-in-part of application No. 11/742,488, filed on Apr. 30, 2007, now abandoned.

(60) Provisional application No. 60/896,184, filed on Mar. 21, 2007.

(51) Int. Cl.

| | |
|---|---|
| ***G10L 19/008*** | (2013.01) |
| ***H04S 7/00*** | (2006.01) |
| *H04R 27/00* | (2006.01) |

(52) U.S. Cl.

CPC ..... *H04S 7/302* (2013.01); *H04R 27/00* (2013.01); *H04S 7/305* (2013.01); *H04S 2400/11* (2013.01); *H04S 2400/13* (2013.01); *H04S 2420/07* (2013.01); *H04S 2420/11* (2013.01)

(58) Field of Classification Search

CPC ..... G10L 19/008; H04R 27/00; H04S 7/00; H04S 7/302; H04S 7/305; H04S 2400/11; H04S 2400/13; H04S 2420/07; H04S 2420/11

USPC ..... 704/205, 225, 278, 500; 381/1, 23, 92, 381/17, 19

See application file for complete search history.

(56) References Cited

U.S. PATENT DOCUMENTS 5,208,860 A 5/1993 Lowe et al.
5,812,674 A 9/1998 Jot et al.

(Continued)

FOREIGN PATENT DOCUMENTS

EP 1016320 A2 7/2000
EP 1016320 B1 7/2000

(Continued)

OTHER PUBLICATIONS

Daniel, J. et al.; "Ambisonics Encoding of Other Audio Formats for Multiple Listening Conditions"; Sep. 26-29, 1998; Presented at the105th AES Convention, San Franciso, California, 29 pages.

(Continued)

*Primary Examiner* — Martin Lerner
(74) *Attorney, Agent, or Firm* — Michael A. Glenn; Perkins Coie LLP

(57) ABSTRACT

An audio signal having at least one audio channel and associated direction parameters indicating a direction of origin of a portion of the audio channel with respect to a recording position is reconstructed to derive a reconstructed audio signal. A desired direction of origin with respect to the recording position is selected. The portion of the audio channel is modified for deriving a reconstructed portion of the reconstructed audio signal, wherein the modifying includes increasing an intensity of the portion of the audio channel having direction parameters indicating a direction of origin close to the desired direction of origin with respect to another portion of the audio channel having direction parameters indicating a direction of origin further away from the desired direction of origin.

18 Claims, 5 Drawing Sheets

(56) References Cited

U.S. PATENT DOCUMENTS

| | | | | |
|---|---|---|---|---|
| 5,870,484 | A | 2/1999 | Greenberger | |
| 5,873,059 | A | 2/1999 | Iijima et al. | |
| 5,909,664 | A | 6/1999 | Davis et al. | |
| 5,926,400 | A * | 7/1999 | Kytle et al. | 381/18 |
| 6,343,131 | B1 | 1/2002 | Huopaniemi | |
| 6,446,037 | B1 * | 9/2002 | Fielder et al. | 704/229 |
| 6,628,787 | B1 | 9/2003 | McGrath et al. | |
| 6,694,033 | B1 | 2/2004 | Rimell et al. | |
| 6,718,039 | B1 | 4/2004 | Klayman et al. | |
| 6,836,243 | B2 | 12/2004 | Kajala et al. | |
| 7,110,953 | B1 | 9/2006 | Edler et al. | |
| 7,184,559 | B2 * | 2/2007 | Jouppi | 381/92 |
| 7,243,073 | B2 | 7/2007 | Yeh et al. | |
| 7,567,676 | B2 * | 7/2009 | Griesinger | 381/56 |
| 7,668,722 | B2 | 2/2010 | Villemoes et al. | |
| 7,756,275 | B2 * | 7/2010 | Crundwell et al. | 381/59 |
| 7,783,594 | B1 * | 8/2010 | Pachikov | 707/609 |
| 7,853,022 | B2 * | 12/2010 | Thompson et al. | 381/17 |
| 8,194,861 | B2 * | 6/2012 | Henn et al. | 381/22 |
| 8,270,641 | B1 * | 9/2012 | Greenberg | 381/306 |
| 8,280,538 | B2 | 10/2012 | Kim et al. | |
| 8,290,167 | B2 * | 10/2012 | Pulkki et al. | 381/23 |
| 8,295,493 | B2 * | 10/2012 | Faller | 381/1 |
| 8,379,868 | B2 | 2/2013 | Goodwin et al. | |
| 8,472,631 | B2 | 6/2013 | Klayman et al. | |
| 2003/0035553 | A1 * | 2/2003 | Baumgarte et al. | 381/94.2 |
| 2004/0013278 | A1 * | 1/2004 | Yamada | 381/309 |
| 2004/0091118 | A1 | 5/2004 | Griesinger | |
| 2004/0151325 | A1 | 8/2004 | Hooley et al. | |
| 2004/0179696 | A1 * | 9/2004 | Ohta | 381/56 |
| 2004/0205204 | A1 | 10/2004 | Chafe | |
| 2005/0053242 | A1 | 3/2005 | Henn et al. | |
| 2005/0180579 | A1 * | 8/2005 | Baumgarte et al. | 381/63 |
| 2005/0222841 | A1 * | 10/2005 | McDowell | 704/212 |
| 2005/0249367 | A1 | 11/2005 | Bailey | |
| 2006/0004583 | A1 | 1/2006 | Herre | |
| 2006/0093128 | A1 | 5/2006 | Oxford | |
| 2006/0093152 | A1 | 5/2006 | Thompson et al. | |
| 2006/0140417 | A1 * | 6/2006 | Zurek | 381/92 |
| 2006/0171547 | A1 | 8/2006 | Lokki et al. | |
| 2007/0003069 | A1 * | 1/2007 | Faller | 381/17 |
| 2007/0127733 | A1 | 6/2007 | Henn et al. | |
| 2007/0189551 | A1 * | 8/2007 | Kimijima | 381/97 |
| 2007/0269063 | A1 | 11/2007 | Goodwin et al. | |
| 2008/0008327 | A1 * | 1/2008 | Ojala et al. | 381/20 |
| 2008/0232601 | A1 * | 9/2008 | Pulkki | 381/1 |
| 2008/0232616 | A1 * | 9/2008 | Pulkki et al. | 381/300 |
| 2009/0034766 | A1 | 2/2009 | Hamanaka et al. | |
| 2009/0034772 | A1 * | 2/2009 | Iida et al. | 381/356 |
| 2010/0166191 | A1 * | 7/2010 | Herre et al. | 381/1 |

FOREIGN PATENT DOCUMENTS

| | | | |
|---|---|---|---|
| EP | 1275272 | A1 | 1/2003 |
| EP | 1761110 | | 3/2007 |
| JP | 06-506092 | | 7/1994 |
| JP | 07-222299 | | 8/1995 |
| JP | 10-304498 | | 11/1998 |
| JP | 2001-275197 | | 10/2001 |
| JP | 2003274492 | | 9/2003 |
| JP | 2004-504787 | | 2/2004 |
| JP | 2006-087130 | | 3/2006 |
| JP | 2006-146415 | | 6/2006 |
| JP | 2006-37839 | | 9/2006 |
| JP | 2007-533221 | | 11/2007 |
| KR | 10-2007-0001227 | | 1/2007 |
| KR | 10-2007-0042145 | | 4/2007 |
| RU | 2092979 | C1 | 10/1997 |
| RU | 2129336 | C1 | 4/1999 |
| RU | 2234819 | C2 | 8/2004 |
| TW | I236307 | | 2/2004 |
| TW | 200629240 | | 8/2006 |
| WO | WO-92/15180 | | 9/1992 |
| WO | WO0182651 | A | 11/2001 |
| WO | WO02/07481 | A2 | 1/2002 |
| WO | WO 200407784 | A | 9/2004 |
| WO | WO-2005/101905 | | 10/2005 |
| WO | WO2005117483 | | 12/2005 |
| WO | WO-2006/003813 | | 1/2006 |
| WO | WO-2006-137400 | | 12/2006 |

OTHER PUBLICATIONS

European Patent Office Correspondence, mailed Feb. 24, 2011, in related European Patent Application No. 08707513.1-2225, 6 pages.

Herre, et al.; "The Reference Model Architecture for MPEG Spatial Audio Coding": May 28, 2005, AES Convention paper, pp. 1-13; New York, NY, XP009059973.

Lipshitz, Stanley P., "Stereo Microphone Techniques . . . Are the Purists Wrong?"; Sep. 1986, Journal of the Audio Engineering Society, vol. 34, No. 9 , pp. 716-744.

Gerzon, Michael A., "Periphone: With-Height Sound Reproduction"; Jan./Feb. 1973, Journal of the Audio Engineering Society, vol. 21, No. 1, pp. 2-10.

Laborie, Arnaud, et al., "Designing High Spatial Resolution Microphones," Oct. 28-31, 2004, Journal of the Audio Engineering Society, Convention Paper 6231, Presented at the 117th Convention, San Francisco, CA.

Merimaa, Juha, et al., "Spatial Impulse Response Rendering I: Analysis and Synthesis," Dec. 2005, Journal of the Audio Engineering Society, vol. 53, No. 12, pp. 1115-1127.

Pulkki, Ville, et al., "Directional Audio Coding: Filterbank and STFT-based Design," May 20-23, 2006, Journal of the Audio Engineering Society, AES 120$^{th}$ Convention, Paris, France, Preprint 6658.

Nelisse, H. et al., "Characterization of a Diffuse Field in a Reverberant Room," Jun. 1997, Journal of the Acoustical Society of America, vol. 101, No. 6, pp. 3517-3524.

Okano, Toshiyuki, et al., "Relations Among Interaural Cross-Correlation Coefficient (IACCe), Lateral Fraction (LFe), and Apparent Source Width (ASW) in Concert Halls," Jul. 1998, Journal of the Acoustical Society of America, vol. 104, No. 1, pp. 255-265.

Pulkki, Ville, et al., "Spatial Impulse Response Rendering II: Reproduction of Diffuse Sound and Listening Tests," Jan./Feb. 2006, Journal of the Audio Engineering Society, vol. 54, No. ½, pp. 3-20.

Atal, B.S., et al., "Perception of Coloration in Filtered Gaussian Noise—Short-Time Spectral Analysis by the Ear," Aug. 21-28, 1962, Fourth International Congress on Acoustics, Copenhagen.

Culling, John F., et al., "Dichotic Pitches as Illusions of Binaural Unmasking," Jun. 1998, Journal of the Acoustical Society of America, vol. 103, No. 6, pp. 3509-3526.

Bruggen, Marc, et al., "Coloration and Binaural Decoloration in Natural Environments," Apr. 19, 2001, Acustica, vol. 87, pp. 400-406.

Faller, Christof, et al., "Source Localization in Complex Listening Situations: Selection of Binaural Cues based on Interaural Coherence," Nov. 2004, Journal of the Acoustical Society of America, vol. 116, No. 5, pp. 3075-3089.

Pulkki, Ville, "Virtual Sound Source Positioning Using Vector Base Amplitude Panning," Jun. 1997, Journal of the Audio Engineering Society, vol. 45, No. 6, pp. 456-466.

Schulein, Robert B., "Microphone Considerations in Feedback-Prone Environments"; Presented Oct. 7, 1971 at the 41st Convention of the Audio Engineering Society, New York; published Jul./Aug. 1976 in the Journal of the Audio Engineering Society, vol. 24, No. 6, pp. 434-445.

Avendano, Carlos, "A Frequency-Domain Approach to Multichannel Upmix," Jul./Aug. 2004, Journal of the Audio Engineering Society, vol. 52, No. 7/8, pp. 740-749.

Dressler, Roger, "Dolby Surround Pro Logic II Decoder—Principles of Operation," Aug. 2004, Dolby Publication, http:www.dolby.com/assets/pdf/tech_library/209_Dolby_Surround_Pro_Logic_II_Decoder_Principles_of_Operation.pdf.

Avendano, Carlos, et al., "Ambience Extraction and Synthesis from Stereo Signals for Multi-Channel Audio Up-Mix," 2002, Creative Advanced Technology Center, pp. II-1957 through II-1960.

Bitzer, Joerg, et al., "Superdirective Microphone Arrays", in M. Brandstein, D. Ward edition: Microphone Arrays—Signal Process-

(56) References Cited

OTHER PUBLICATIONS ing Techniques and Applications, Chapter 2, pp. 19-38; Springer Berlin 2001, ISBN: 978-3-540-41953-2.
Faller, Christof, "Multiple-Loudspeaker Playback of Stereo Signals," Nov. 2006, Journal of the Audio Engineering Society, vol. 54, No. 11, pp. 1051-1064.
Griesinger, David, "Multichannel Matrix Surround Decoders for Two-Eared Listeners," Nov. 8-11, 1996, Journal of the Audio Engineering Society, 101st AES Convention, Los Angeles, California, Preprint 4402.
Villemoes, Lars, et al., "MPEG Surround: The Forthcoming ISO Standard for Spatial Audio Coding," Jun. 30,-Jul. 2, 2006, AES 28th International Conference, pp. 1-18; Pitea, Sweden.
Pulkki, V., "Directional Audio Coding in Spatial Sound Reproduction and Stereo Upmixing," Jun. 30,-Jul. 2, 2006, Proceedings of the AES 28th International Conference, No. 251-258, Pitea, Sweden.
ITU-R. Rec. BS.775-1, "Multi-Channel Stereophonic Sound System With and Without Accompanying Picture," 1992-1994, International Telecommunications Union, pp. 1-11; Geneva, Switzerland.
Simmer, K. Uwe, et al., "Post Filtering Techniques," in M. Brandstein, D. Ward edition: *Microphone Arrays—Singal Processing Techniques and Applications*, 2001; Chapter 3, pp. 39-60; Springer Berlin 2001, ISBN: 978-3-540-41953-2.
Streicher, Ron, et al., "Basic Stereo Microphone Perspectives A Review," May 11-14, 1984, Presented at the 2nd AES Int'l Conference, Anaheim, CA; published Jul./Aug. 1985 in the Journal of the Audio Engineering Society, vol. 33, No. 7/8, pp. 548-556.
Chen, Jingdong, et al., "Time Delay Estimation in Room Acoustic Environments: An Overview," 2006, EURASIP Journal on Applied Signal Processing, vol. 2006, Article 26503, pp. 1-19.
Zielinski, Slawomir K., "Comparison of Basic Audio Quality and Timbral and Spatial Fidelity Changes Caused by Limitation of Bandwith and by Down-mix Algroithms in 5.1 Surround Audio Systems," Mar. 2005, Journal of the Audio Engineering Society, vol. 53, No. 3, pp. 174-192.
Elko, Gary W., "Superdirectional Microphone Arrays," in S.G. Gay, J. Benesty edition: *Acoustic signal Processing for Telecommunication*, 2000, Chapter 10, Kluwer Academic Press; ISBN: 978-0792378143.
Bilsen, Frans A., "Pitch of Noise Signals: Evidence for a 'Central Spectrum'"; Jan. 1977, Journal of the Acoustical Society of America, vol. 61, No. 1, pp. 150-161.
Bronkhorst, A.W., et al., "The Effect of Head-Induced Interaural Time and Level Differences on Speech Intelligibility in Noise," Apr. 1988, Journal of the Acoustical Society of America, vol. 83, No. 4, pp. 1508-1516.
Bech, Soren, "Timbral Aspects or Reproduced Sound in Small Rooms, I," Mar. 1995, Journal of the Acoustical Society of America, vol. 97, No. 3, pp. 1717-1726.
Allen, Jont B., "Image Method for Efficiently Simulating Small-Room Acoustics"; Apr. 1979, Journal of the Acoustical Society of America, vol. 65, No. 4, pp. 943-950.
The Russian Decision to grant mailed Sep. 7, 2010 in related Russian Patent Application No. 2009134471/09(048571); 10 pages.
Pulkki, V. , "Applications of Directional Audio Coding in Audio", 19th International Congress of Acoustics, International Commission for Acoustics, retrieved online from http://decoy.iki.fi/dsound/ambisonic/motherlode/source/rba-15-2002.pdf, Sep. 2007, 6 pages.

* cited by examiner

RECONSTRUCTION OF AUDIO CHANNELS WITH DIRECTION PARAMETERS INDICATING DIRECTION OF ORIGIN

CROSS REFERENCE TO RELATED APPLICATIONS

This application is a national phase entry of PCT Patent Application Ser. No. PCT/EP2008/000829, filed Feb. 01, 2008, which claims priority to U.S. Provisional Patent Application Ser. No. 60/896,184, filed on Mar. 21, 2007 and this application is a Continuation-in-part of U.S. patent application Ser. No. 11/742,488, filed on Apr. 30, 2007, all of which are herein incorporated in their entirety by this reference thereto.

BACKGROUND OF THE INVENTION

The present invention relates to techniques as to how to improve the perception of a direction of origin of a reconstructed audio signal. In particular, the present invention proposes an apparatus and a method for reproduction of recorded audio signals such that a selectable direction of audio sources can be emphasized or over-weighted with respect to audio signals coming from other directions.

Generally, in multi-channel reproduction and listening, a listener is surrounded by multiple loudspeakers. Various methods exist to capture audio signals for specific set-ups. One general goal in the reproduction is to reproduce the spatial composition of the originally recorded signal, i.e. the origin of individual audio source, such as the location of a trumpet within an orchestra. Several loudspeaker set-ups are fairly common and can create different spatial impressions. Without using special post-production techniques, the commonly known two-channel stereo set-ups can only recreate auditory events on a line between the two loudspeakers. This is mainly achieved by so-called "amplitude-panning", where the amplitude of the signal associated to one audio source is distributed between the two loudspeakers, depending on the position of the audio source with respect to the loudspeakers. This is usually done during recording or subsequent mixing. That is, an audio source coming from the far-left with respect to the listening position will be mainly reproduced by the left loudspeaker, whereas an audio source in front of the listening position will be reproduced with identical amplitude (level) by both loudspeakers. However, sound emanating from other directions cannot be reproduced.

Consequently, by using more loudspeakers that are positioned around the listener, more directions can be covered and a more natural spatial impression can be created. The probably most well known multi-channel loudspeaker layout is the 5.1 standard (ITU-R775-1), which consists of 5 loudspeakers, whose azimuthal angles with respect to the listening position are predetermined to be 0°, ±30° and ±110°. That means, that during recording or mixing the signal is tailored to that specific loudspeaker configuration and deviations of a reproduction set-up from the standard will result in decreased reproduction quality.

Numerous other systems with varying numbers of loudspeakers located at different directions have also been proposed. Professional and special systems, especially in theaters and sound installations, also include loudspeakers at different heights.

According to the different reproduction set-ups, several different recording methods have been designed and proposed for the previously mentioned loudspeaker systems, in order to record and reproduce the spatial impression in the listening situation as it would have been perceived in the recording environment. A theoretically ideal way of recording spatial sound for a chosen multi-channel loudspeaker system would be to use the same number of microphones as there are loudspeakers. In such a case, the directivity patterns of the microphones should also correspond to the loudspeaker layout, such that sound from any single direction would only be recorded with a small number of microphones (1, 2 or more). Each microphone is associated to a specific loudspeaker. The more loudspeakers are used in reproduction, the narrower the directivity patterns of the microphones have to be. However, narrow directional microphones are rather expensive and typically have a non-flat frequency response, degrading the quality of the recorded sound in an undesirable manner. Furthermore, using several microphones with too broad directivity patterns as input to multi-channel reproduction results in a colored and blurred auditory perception due to the fact that sound emanating from a single direction would be reproduced with more loudspeakers than necessary, as it would be recorded with microphones associated to different loudspeakers. Generally, currently available microphones are best suited for two-channel recordings and reproductions, that is, these are designed without the goal of a reproduction of a surrounding spatial impression.

From the point of view of microphone-design, several approaches have been discussed to adapt the directivity patterns of microphones to the demands in spatial-audio-reproduction. Generally, all microphones capture sound differently depending on the direction of arrival of the sound to the microphone. That is, microphones have a different sensitivity, depending on the direction of arrival of the recorded sound. In some microphones, this effect is minor, as they capture sound almost independently of the direction. These microphones are generally called omnidirectional microphones. In a typical microphone design, a circular diaphragm is attached to a small airtight enclosure. If the diaphragm is not attached to the enclosure and sound reaches it equally from each side, its directional pattern has two lobes. That is, such a microphone captures sound with equal sensitivity from both front and back of the diaphragm, however, with inverse polarities. Such a microphone does not capture sound coming from the direction coincident to the plane of the diaphragm, i.e. perpendicular to the direction of maximum sensitivity. Such a directional pattern is called dipole, or figure-of-eight.

Omnidirectional microphones may also be modified into directional microphones, using a non-airtight enclosure for the microphone. The enclosure is especially constructed such, that the sound waves are allowed to propagate through the enclosure and reach the diaphragm, wherein some directions of propagation are advantageous, such that the directional pattern of such a microphone becomes a pattern between omnidirectional and dipole. Those patterns may, for example, have two lobes. However, the lobes may have different strength. Some commonly known microphones have patterns that have only one single lobe. The most important example is the cardioid pattern, where the directional function D can be expressed as $D=1+\cos(\theta)$, $\theta$ being the direction of arrival of sound. The directional function thus quantifies, what fraction of the incoming sound amplitude is captured, depending on the direction.

The previously discussed omnidirectional patterns are also called zeroth-order patterns and the other patterns mentioned previously (dipole and cardioid) are called first-order patterns. All previously discussed microphone designs do not allow arbitrary shaping of the directivity patterns, since their directivity pattern is entirely determined by their mechanical construction.

To partly overcome this problem, some specialized acoustical structures have been designed, which can be used to create narrower directional patterns than those of first-order microphones. For example, when a tube with holes in it is attached to an omnidirectional microphone, a microphone with narrow directional pattern can be created. These microphones are called shotgun or rifle microphones. However, they typically do not have a flat frequency response, that is, the directivity pattern is narrowed at the cost of the quality of the recorded sound. Furthermore, the directivity pattern is predetermined by the geometric construction and, thus, the directivity pattern of a recording performed with such a microphone cannot be controlled after the recording.

Therefore, other methods have been proposed to partly allow to alter the directivity pattern after the actual recording. Generally, this relies on the basic idea of recording sound with an array of omnidirectional or directional microphones and to apply signal processing afterwards. Various such techniques have been recently proposed. A fairly simple example is to record sound with two omnidirectional microphones, which are placed close to each other, and to subtract both signals from each other. This creates a virtual microphone signal having a directional pattern equivalent to a dipole.

In other, more sophisticated schemes the microphone signals can also be delayed or filtered before summing them up. Using beam forming, a technique also known from wireless LAN, a signal corresponding to a narrow beam is formed by filtering each microphone signal with a specially designed filter and summing the signals up after the filtering (filter-sum beam forming). However, these techniques are blind to the signal itself, that is, they are not aware of the direction of arrival of the sound. Thus, a predetermined directional pattern may be defined, which is independent of the actual presence of a sound source in the predetermined direction. Generally, estimation of the "direction of arrival" of sound is a task of its own.

Generally, numerous different spatial directional characteristics can be formed with the above techniques. However, forming arbitrary spatially selective sensitivity patterns (i.e. forming narrow directional patterns) necessitates a large number of microphones.

An alternative way to create multi-channel recordings is to locate a microphone close to each sound source (e.g. an instrument) to be recorded and recreate the spatial impression by controlling the levels of the close-up microphone signals in the final mix. However, such a system demands a large number of microphones and a lot of user interaction in creating the final down-mix.

A method to overcome the above problem has been recently proposed and is called directional audio coding (DirAC), which may be used with different microphone systems and which is able to record sound for reproduction with arbitrary loudspeaker set-ups. The purpose of DirAC is to reproduce the spatial impression of an existing acoustical environment as precisely as possible, using a multi-channel loudspeaker system having an arbitrary geometrical set-up. Within the recording environment, the responses of the environment (which may be continuous recorded sound or impulse responses) are measured with an omnidirectional microphone (W) and with a set of microphones allowing to measure the direction of arrival of sound and the diffuseness of sound. In the following paragraphs and within the application, the term "diffuseness" is to be understood as a measure for the non-directivity of sound. That is, sound arriving at the listening or recording position with equal strength from all directions, is maximally diffuse. A common way of quantifying diffusion is to use diffuseness values from the interval [0, . . . , 1], wherein a value of 1 describes maximally diffuse sound and a value of 0 describes perfectly directional sound, i.e. sound arriving from one clearly distinguishable direction only. One commonly known method of measuring the direction of arrival of sound is to apply 3 figure-of-eight microphones (XYZ) aligned with Cartesian coordinate axes. Special microphones, so-called "SoundField microphones", have been designed, which directly yield all desired responses. However, as mentioned above, the W, X, Y and Z signals may also be computed from a set of discrete omnidirectional microphones.

In DirAC analysis, a recorded sound signal is divided into frequency channels, which correspond to the frequency selectivity of human auditory perception. That is, the signal is, for example, processed by a filter bank or a Fourier-transform to divide the signal into numerous frequency channels, having a bandwidth adapted to the frequency selectivity of the human hearing. Then, the frequency band signals are analyzed to determine the direction of origin of sound and a diffuseness value for each frequency channel with a predetermined time resolution. This time resolution does not have to be fixed and may, of course, be adapted to the recording environment. In DirAC, one or more audio channels are recorded or transmitted, together with the analyzed direction and diffuseness data.

In synthesis or decoding, the audio channels finally applied to the loudspeakers can be based on the omnidirectional channel W (recorded with a high quality due to the omnidirectional directivity pattern of the microphone used), or the sound for each loudspeaker may be computed as a weighted sum of W, X, Y and Z, thus forming a signal having a certain directional characteristic for each loudspeaker. Corresponding to the encoding, each audio channel is divided into frequency channels, which are optionally furthermore divided into diffuse and non-diffuse streams, depending on analyzed diffuseness. If diffuseness has been measured to be high, a diffuse stream may be reproduced using a technique producing a diffuse perception of sound, such as the decorrelation techniques also used in Binaural Cue Coding. Non-diffuse sound is reproduced using a technique aiming to produce a point-like virtual audio source, located in the direction indicated by the direction data found in the analysis, i.e. the generation of the DirAC signal. That is, spatial reproduction is not tailored to one specific, "ideal" loudspeaker set-up, as in the conventional techniques (e.g. 5.1). This is particularly the case, as the origin of sound is determined as direction parameters (i.e. described by a vector) using the knowledge about the directivity patterns on the microphones used in the recording. As already discussed, the origin of sound in 3-dimensional space is parameterized in a frequency selective manner. As such, the directional impression may be reproduced with high quality for arbitrary loudspeaker set-ups, as far as the geometry of the loudspeaker set-up is known. DirAC is therefore not limited to special loudspeaker geometries and generally allows for a more flexible spatial reproduction of sound.

Although numerous techniques have been developed to reproduce multi-channel audio recordings and to record appropriate signals for a later multi-channel reproduction, none of the conventional techniques allows to influence an already recorded signal such that a direction of origin of audio signals can be emphasized during reproduction such that, for example, the intelligibility of the signal from one distinct desired direction may be enhanced.

SUMMARY

According to an embodiment, a method for reconstructing an audio signal having at least one audio channel and associated direction parameters indicating a direction of origin of a portion of the audio channel with respect to, a recording position, may have the steps of: selecting a set direction of origin with respect to the recording position; and modifying the portion of the audio channel for deriving a reconstructed portion of the reconstructed audio signal, wherein the modification has increasing an intensity of the portion of the audio channel having direction parameters indicating a direction of origin close to the set direction of origin with respect to another portion of the audio channel having direction parameters indicating a direction of origin further away from the set direction of origin.

According to another embodiment, an audio decoder for reconstructing an audio signal having at least one audio channel and associated direction parameters indicating a direction of origin of a portion of the audio channel with respect to a recording position, may have: a direction selector adapted to select a set direction of origin with respect to the recording position; and an audio portion modifier for modifying the portion of the audio channel for deriving a reconstructed portion of the reconstructed audio signal, wherein the modification has increasing an intensity of the portion of the audio channel having direction parameters indicating a direction of origin close to the set direction of origin with respect to another portion of the audio channel having direction parameters indicating a direction of origin further away from the set direction of origin.

According to another embodiment, an audio encoder for enhancing a directional perception of an audio signal may have: a signal generator for deriving at least one audio channel and associated direction parameters indicating a direction of origin of a portion of the audio channel with respect to a recording position; a direction selector adapted to select a set direction of origin with respect to the recording position; and a signal modifier for modifying the portion of the audio channel for deriving a portion of an enhanced audio signal, wherein the modification has increasing an intensity of a portion of the audio channel having direction parameters indicating a direction of origin close to a set direction of origin with respect to another portion of the audio channel having direction parameters indicating a direction of origin further away from the set direction of origin.

According to another embodiment, a system for enhancement of a reconstructed audio signal may have: an audio encoder for deriving an audio signal having at least one audio channel and associated direction parameters indicating a direction of origin of a portion of the audio channel with respect to a recording position; a direction selector adapted to select a set direction of origin with respect to the recording position; and an audio decoder having an audio portion modifier for modifying the portion of the audio channel for deriving a reconstructed portion of the reconstructed audio signal, wherein the modifying has increasing an intensity of the portion of the audio channel having direction parameters indicating a direction of origin close to a set direction of origin with respect to another portion of the audio channel having direction parameters indicating a direction of origin further away from the set direction of origin.

According to another embodiment, a computer program, when running on a computer, may implement a method for reconstructing an audio signal having at least one audio channel and associated direction parameters indicating a direction of origin of a portion of the audio channel with respect to a recording position, the method having the steps of: selecting a set direction of origin with respect to the recording position; and modifying the portion of the audio channel for deriving a reconstructed portion of the reconstructed audio signal, wherein the modification has increasing an intensity of the portion of the audio channel having direction parameters indicating a direction of origin close to the set direction of origin with respect to another portion of the audio channel having direction parameters indicating a direction of origin further away from the set direction of origin.

According to one embodiment of the present invention, an audio signal having at least one audio channel and associated direction parameters indicating the direction of origin of a portion of the audio channel with respect to a recording position can be reconstructed allowing for an enhancement of the perceptuality of the signal coming from a distinct direction or from numerous distinct directions.

That is, in reproduction, a desired direction of origin with respect to the recording position can be selected. While deriving a reconstructed portion of the reconstructed audio signal, the portion of the audio channel is modified such that the intensity of portions of the audio channel having direction parameters indicating a direction of origin close to the desired direction of origin are increased with respect to other portions of the audio channel having direction parameters indicating a direction of origin further away from the desired direction of origin. Directions of origin of portions of an audio channel or a multi-channel signal can be emphasized, such as to allow for a better perception of audio objects, which were located in the selected direction during the recording.

According to a further embodiment of the present invention, a user may choose during reconstruction, which direction or which directions shall be emphasized such that portions of the audio channel or portions of multiple audio channels, which are associated to that chosen direction are emphasized, i.e. their intensity or amplitude is increased with respect to the remaining portions. According to an embodiment, emphasis or attenuation of sound from a specific direction can be done with a much sharper spatial resolution than with systems not implementing direction parameters. According to a further embodiment of the present invention, arbitrary spatial weighting functions can be specified, which cannot be achieved with regular microphones. Furthermore, the weighting functions may be time and frequency variant, such that further embodiments of the present invention may be used with high flexibility. Furthermore, the weighting functions are extremely easy to implement and to update, since these have only to be loaded into the system instead of exchanging hardware (for example, microphones).

According to a further embodiment of the present invention, audio signals having associated a diffuseness parameter, the diffuseness parameter indicating a diffuseness of the portion of the audio channel, are reconstructed such that an intensity of a portion of the audio channel with high diffuseness is decreased with respect to another portion of the audio channel having associated a lower diffuseness.

Thus, in reconstructing an audio signal, diffuseness of individual portions of the audio signal can be taken into account to further increase the directional perception of the reconstructed signal. This may, additionally, increase the redistribution of audio sources with respect to techniques only using diffuse sound portions to increase the overall diffuseness of the signal rather than making use of the diffuseness information for a better redistribution of the audio sources. Note that the present invention also allows to conversely emphasize portions of the recorded sound that are of diffuse origin, such as ambient signals.

According to a further embodiment, at least one audio channel is up-mixed to multiple audio channels. The multiple audio channels might correspond to the number of loudspeakers available for playback. Arbitrary loudspeaker set-ups may be used to enhance the redistribution of audio sources while it can be guaranteed that the direction of the audio source is reproduced as good as possible with the existing equipment, irrespective of the number of loudspeakers available.

According to another embodiment of the present invention, reproductions may even be performed via a monophonic loudspeaker. Of course, the direction of origin of the signal will, in that case, be the physical location of the loudspeaker. However, by selecting a desired direction of origin of the signal with respect to the recording position, the audibility of the signal stemming from the selected direction can be significantly increased, as compared to the playback of a simple down-mix.

According to a further embodiment of the present invention, the direction of origin of the signal can be accurately reproduced, when one or more audio channels are up-mixed to the number of channels corresponding to the loudspeakers. The direction of origin can be reconstructed as good as possible by using, for example, amplitude panning techniques. To further increase the perceptual quality, additional phase shifts may be introduced, which are also dependent on the selected direction.

Certain embodiments of the present invention may additionally decrease the cost of the microphone capsules for recording the audio signal without seriously affecting the audio quality, since at least the microphone used to determine the direction/diffusion estimate does not necessarily need to have a flat frequency response.

BRIEF DESCRIPTION OF THE DRAWINGS

Embodiments of the present invention will be detailed subsequently referring to the appended drawings, in which.

DETAILED DESCRIPTION OF THE INVENTION

Figure 1:
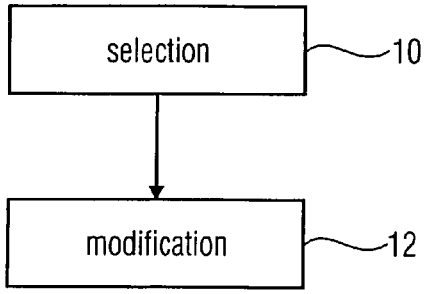
FIG. 1 shows an embodiment of a method for reconstructing an audio signal.

FIG. 1 shows an embodiment of a method for reconstructing an audio signal having at least one audio channel and associated direction parameters indicating a direction of origin of a portion of the audio channel with respect to a recording position. In a selection step 10, a desired direction of origin with respect to the recording position is selected for a reconstructed portion of the reconstructed audio signal, wherein the reconstructed portion corresponds to a portion of the audio channel. That is, for a signal portion to be processed, a desired direction of origin, from which signal portions shall be clearly audible after reconstruction, is selected. The selection can be done directly by a user input or automatically, as detailed below.

The portion may be a time portion, a frequency portion, or a time portion of a certain frequency interval of an audio channel. In a modification step 12, the portion of the audio channel is modified for deriving the reconstructed portion of the reconstructed audio signal, wherein the modification comprises increasing an intensity of a portion of the audio channel having direction parameters indicating a direction of origin close to the desired direction of origin with respect to another portion of the audio channel having direction parameters indicating a direction of origin further away from the desired direction of origin. That is, such portions of the audio channel are emphasized by increasing their intensity or level, which can, for example, be implemented by the multiplication of a scaling factor to the portion of the audio channel. According to an embodiment, portions originating from a direction close to the selected (desired) direction are multiplied by large scale factors, to emphasize these signal portions in reconstruction and to improve the audibility of those audio recorded objects, in which the listener is interested in. Generally, in the context of this application, increasing the intensity of a signal or a channel shall be understood as any measure which renders the signal to be better audible. This could for example be increasing the signal amplitude, the energy carried by the signal or multiplying the signal with a scale factor greater than unity. Alternatively, the loudness of competing signals may be decreased to achieve the effect.

The selection of the desired direction may be directly performed via a user interface by a user at the listening site. However, according to alternative embodiments, the selection can be performed automatically, for example, by an analysis of the directional parameters, such that frequency portions having roughly the same origin are emphasized, whereas the remaining portions of the audio channel are suppressed. Thus, the signal can be automatically focused on the predominant audio sources, without necessitating an additional user input at the listening end.

According to further embodiments, the selection step is omitted, since a direction of origin has been set. That is, the intensity of a portion of the audio channel having direction parameters indicating a direction of origin close to the set direction is increased. The set direction may, for example be hardwired, i.e. the direction may be predetermined. If, for example only the central talker in a teleconferencing scenario is of interest, this can be implemented using a predetermined set direction. Alternative embodiments may read the set direction from a memory which may also have stored a number of alternative directions to be used as set directions. One of these may, for example, be read when turning on an inventive apparatus.

According to an alternative embodiment, the selection of the desired direction may also be performed at the encoder side, i.e. at the recording of the signal, such that additional parameters are transmitted with the audio signal, indicating the desired direction for reproduction. Thus, a spatial perception of the reconstructed signal may already be selected at the encoder without the knowledge on the specific loudspeaker set-up used for reproduction.

Since the method for reconstructing an audio signal is independent of the specific loudspeaker set-up intended to reproduce the reconstructed audio signal, the method may be applied to monophonic as well as to stereo or multi-channel loudspeaker configurations. That is, according to a further embodiment, the spatial impression of a reproduced environment is post-processed to enhanced the perceptibility of the signal.

When used for monophonic playback, the effect may be interpreted as recording the signal with a new type of microphone capable of forming arbitrary directional patterns. However, this effect can be fully achieved at the receiving end, i.e. during playback of the signal, without changing anything in the recording set-up.

Figure 2:
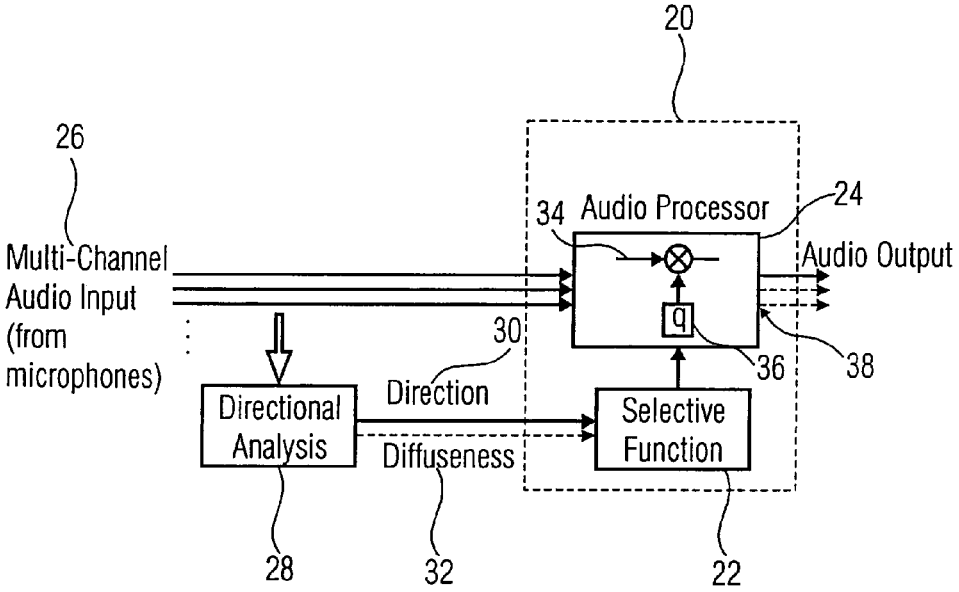
FIG. 2 is a block diagram of an apparatus for reconstructing an audio signal.

FIG. 2 shows an embodiment of an apparatus (decoder) for reconstruction of an audio signal, i.e. an embodiment of a decoder 20 for reconstructing an audio signal. The decoder 20 comprises a direction selector 22 and an audio portion modifier 24. According to the embodiment of FIG. 2 a multi-channel audio input 26 recorded by several microphones is analyzed by a direction analyzer 28 which derives direction parameters indicating a direction of origin of a portion of the audio channels, i.e. the direction of origin of the signal portion analyzed. According to one embodiment of the present invention, the direction, from which most of the energy is incident to the microphone is chosen. The recording position is determined for each specific signal portion. This can, for example, be also done using the DirAC-microphone-techniques previously described. Of course, other directional analysis method based on recorded audio information may be used to implement the analysis. As a result, the direction analyzer 28 derives direction parameters 30, indicating the direction of origin of a portion of an audio channel or of the multi-channel signal 26. Furthermore, the directional analyzer 28 may be operative to derive a diffuseness parameter 32 for each signal portion (for example, for each frequency interval or for each time-frame of the signal).

The direction parameter 30 and, optionally, the diffuseness parameter 32 are transmitted to the direction selector 22 which is implemented to select a desired direction of origin with respect to a recording position for a reconstructed portion of the reconstructed audio signal. Information on the desired direction is transmitted to the audio portion modifier 24. The audio portion modifier 24 receives at least one audio channel 34, having a portion, for which the direction parameters have been derived. The at least one channel modified by audio portion modifier may, for example, be a down-mix of the multi-channel signal 26, generated by conventional multi-channel down-mix algorithms. One extremely simple case would be the direct sum of the signals of the multi-channel audio input 26. However, as the inventive embodiments are not limited by the number of input channels, in an alternative embodiment, all audio input channels 26 can be simultaneously processed by audio decoder 20.

The audio portion modifier 24 modifies the audio portion for deriving the reconstructed portion of the reconstructed audio signal, wherein the modifying comprises increasing an intensity of a portion of the audio channel having direction parameters indicating a direction of origin close to the desired direction of origin with respect to another portion of the audio channel having direction parameters indicating a direction of origin further away from the desired direction of origin. In the example of FIG. 2, the modification is performed by multiplying a scaling factor 36 (q) with the portion of the audio channel to be modified. That is, if the portion of the audio channel is analyzed to be originating from a direction close to the selected desired direction, a large scaling factor 36 is multiplied with the audio portion. Thus, at its output 38, the audio portion modifier outputs a reconstructed portion of the reconstructed audio signal corresponding to the portion of the audio channel provided at its input. As furthermore indicated by the dashed lines at the output 38 of the audio portion modifier 24, this may not only be performed for a mono-output signal, but also for multi-channel output signals, for which the number of output channels is not fixed or predetermined.

In other words, the embodiment of the audio decoder 20 takes its input from such directional analysis as, for example, used in DirAC. Audio signals 26 from a microphone array may be divided into frequency bands according to the frequency resolution of the human auditory system. The direction of sound and, optionally, diffuseness of sound is analyzed depending on time in each frequency channel. These attributes are delivered further as, for example, direction angles azimuth (azi) and elevation (ele), and as diffuseness index Psi, which varies between zero and one.

Then, the intended or selected directional characteristic is imposed on the acquired signals by using a weighting operation on them, which depends on the direction angles (azi and/or ele) and, optionally, on the diffuseness (Psi). Evidently, this weighting may be specified differently for different frequency bands, and will, in general, vary over time.

Figure 3:
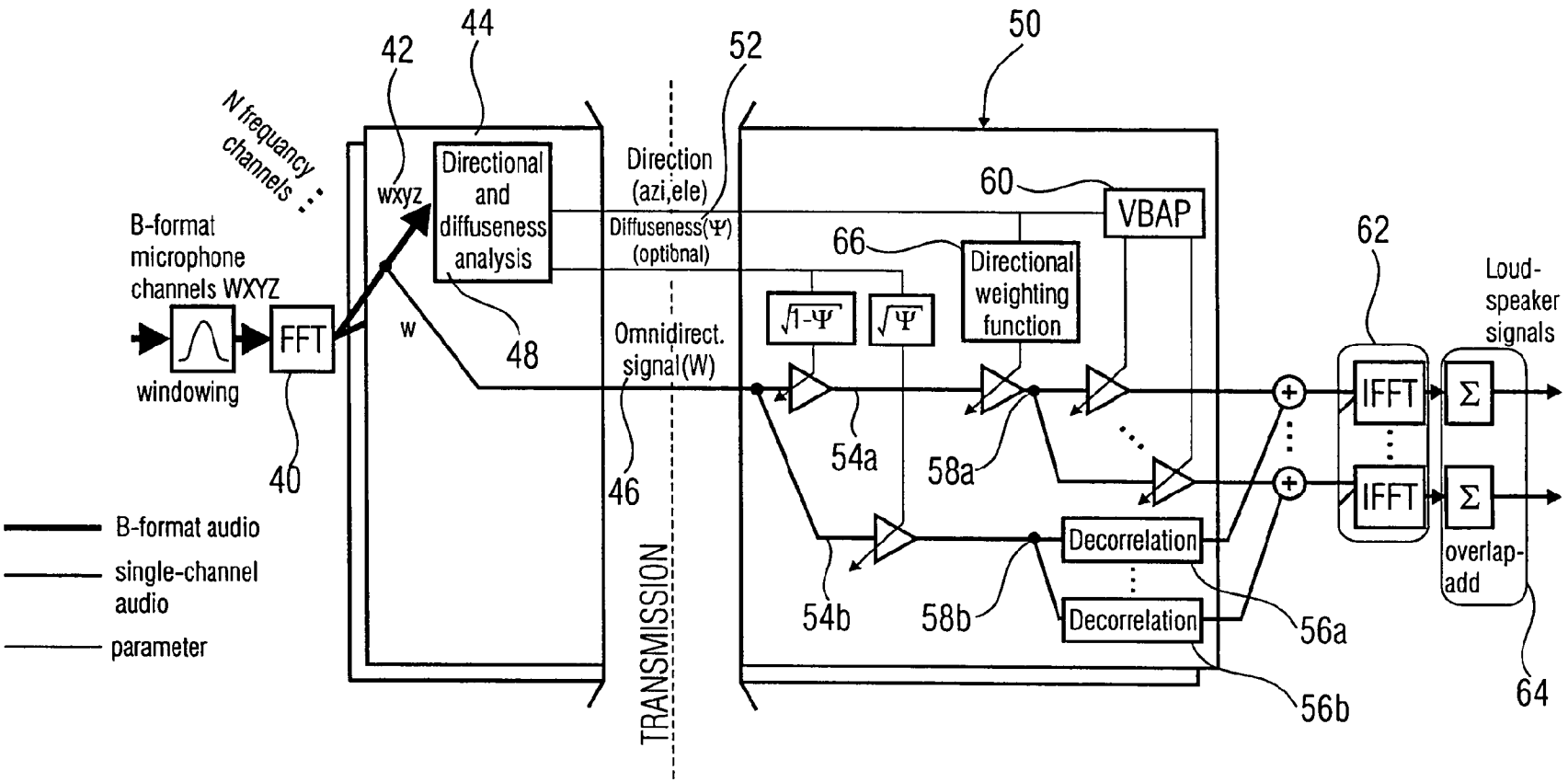
FIG. 3 is a block diagram of a further embodiment.

FIG. 3 shows a further embodiment of the present invention, based on DirAC synthesis. In that sense, the embodiment of FIG. 3 could be interpreted to be an enhancement of DirAC reproduction, which allows to control the level of sound depending on analyzed direction. This makes it possible to emphasize sound coming from one or multiple directions, or to suppress sound from one or multiple directions. When applied in multi-channel reproduction, a post-processing of the reproduced sound image is achieved. If only one channel is used as output, the effect is equivalent to the use of a directional microphone with arbitrary directional patterns during recording of the signal. In the embodiment shown in FIG. 3, the derivation of direction parameters, as well as the derivation of one transmitted audio channel is shown. The analysis is performed based on B-format microphone channels W, X, Y and Z, as, for example, recorded by a sound field microphone.

The processing is performed frame-wise. Therefore, the continuous audio signals are divided into frames, which are scaled by a windowing function to avoid discontinuities at the frame boundaries. The windowed signal frames are subjected to a Fourier transform in a Fourier transform block 40, dividing the microphone signals into N frequency bands. For the sake of simplicity, the processing of one arbitrary frequency band shall be described in the following paragraphs, as the remaining frequency bands are processed equivalently. The Fourier transform block 40 derives coefficients describing the strength of the frequency components present in each of the B-format microphone channels W, X, Y, and Z within the analyzed windowed frame. These frequency parameters 42 are input into audio encoder 44 for deriving an audio channel and associated direction parameters. In the embodiment shown in FIG. 3, the transmitted audio channel is chosen to be the omnidirectional channel 46 having information on the signal from all directions. Based on the coefficients 42 for the omnidirectional and the directional portions of the B-format microphone channels, a directional and diffuseness analysis is performed by a direction analysis block 48.

The direction of origin of sound for the analyzed portion of the audio channel 46 is transmitted to an audio decoder 50 for reconstructing the audio signal together with the omnidirectional channel 46. When diffuseness parameters 52 are present, the signal path is split into a non-diffuse path 54*a* and a diffuse path 54*b*. The non-diffuse path 54*a* is scaled according to the diffuseness parameter, such that, when diffuseness $\Psi$ is high, most of the energy or of the amplitude will remain in the non-diffuse path. Conversely, when the diffuseness is high, most of the energy will be shifted to the diffuse path 54*b*. In the diffuse path 54*b*, the signal is decorrelated or diffused using decorrelators 56*a* or 56*b*. Decorrelation can be performed using conventionally known techniques, such as convolving with a white noise signal, wherein the white noise signal may differ from frequency channel to frequency channel. As long as the decorrelation is energy preserving, a final output can be regenerated by simply adding the signals of the non-diffuse signal path 54*a* and the diffuse signal path 54*b* at the output, since the signals at the signal paths have already been scaled, as indicated by the diffuseness parameter Ψ. The diffuse signal path 54*b* may be scaled, depending on the number of loudspeakers, using an appropriate scaling rule. For example, the signals in the diffuse path may be scaled by $1/\sqrt{N}$, when N is the number of loudspeakers.

When the reconstruction is performed for a multi-channel set-up, the direct signal path 54*a* as well as the diffuse signal path 54*b* are split up into a number of sub-paths corresponding to the individual loudspeaker signals (at split up positions 58*a* and 58*b*). To this end, the split up at the split position 58*a* and 58*b* can be interpreted to be equivalent to an up-mixing of the at least one audio channel to multiple channels for a playback via a loudspeaker system having multiple loudspeakers. Therefore, each of the multiple channels has a channel portion of the audio channel 46. The direction of origin of individual audio portions is reconstructed by redirection block 60 which additionally increases or decreases the intensity or the amplitude of the channel portions corresponding to the loudspeakers used for playback. To this end, redirection block 60 generally necessitates knowledge about the loudspeaker setup used for playback. The actual redistribution (redirection) and the derivation of the associated weighting factors can, for example, be implemented using techniques as vector based amplitude panning. By supplying different geometric loudspeaker setups to the redistribution block 60, arbitrary configurations of playback loudspeakers can be used to implement the inventive concept, without a loss of reproduction quality. After the processing, multiple inverse Fourier transforms are performed on frequency domain signals by inverse Fourier transform blocks 62 to derive a time domain signal, which can be played back by the individual loudspeakers. Prior to the playback, an overlap and add technique may be performed by summation units 64 to concatenate the individual audio frames to derive continuous time domain signals, ready to be played back by the loudspeakers.

According to the embodiment of the invention shown in FIG. 3, the signal processing of Dir-AC is amended in that an audio portion modifier 66 is introduced to modify the portion of the audio channel actually processed and which allows to increase an intensity of a portion of the audio channel having direction parameters indicating a direction of origin close to a desired direction. This is achieved by application of an additional weighting factor to the direct signal path. That is, if the frequency portion processed originates from the desired direction, the signal is emphasized by applying an additional gain to that specific signal portion. The application of the gain can be performed prior to the split point 58*a*, as the effect shall contribute to all channel portions equally.

The application of the additional weighting factor can, in an alternative embodiment, also be implemented within the redistribution block 60 which, in that case, applies redistribution gain factors increased or decreased by the additional weighting factor.

When using directional enhancement in reconstruction of a multi-channel signal, reproduction can, for example, be performed in the style of DirAC rendering, as shown in FIG. 3. The audio channel to be reproduced is divided into frequency bands equal to those used for the directional analysis. These frequency bands are then divided into streams, a diffuse and a non-diffuse stream. The diffuse stream is reproduced, for example, by applying the sound to each loudspeaker after convolution with 30 ms wide noise bursts. The noise bursts are different for each loudspeaker. The non-diffuse stream is applied to the direction delivered from the directional analysis which is, of course, dependent on time. To achieve a directional perception in multi-channel loudspeaker systems, simple pair-wise or triplet-wise amplitude panning may be used. Furthermore, each frequency channel is multiplied by a gain factor or scaling factor, which depends on the analyzed direction. In general terms, a function can be specified, defining a desired directional pattern for reproduction. This can, for example, be only one single direction, which shall be emphasized. However, arbitrary directional patterns are easily implementable with the embodiment of FIG. 3.

In the following approach, a further embodiment of the present invention is described as a list of processing steps. The list is based on the assumption that sound is recorded with a B-format microphone, and is then processed for listening with multi-channel or monophonic loudspeaker set-ups using DirAC style rendering or rendering supplying directional parameters, indicating the direction of origin of portions of the audio channel. The processing is as follows:

1. Divide microphone signals into frequency bands and analyze direction and, optionally, diffuseness at each band depending on frequency. As an example, direction may be parameterized by an azimuth and an elevation angle (azi, ele).
2. Specify a function F, which describes the desired directional pattern. The function may have an arbitrary shape. It typically depends on direction. It may, furthermore, also depend on diffuseness, if diffuseness information is available. The function can be different for different frequencies and it may also be altered depending on time. At each frequency band, derive a directional factor q from the function F for each time instance, which is used for subsequent weighting (scaling) of the audio signal.
3. Multiply the audio sample values with the q values of the directional factors corresponding to each time and frequency portion to form the output signal. This may be done in a time and/or a frequency domain representation. Furthermore, this processing may, for example, be implemented as a part of a DirAC rendering to any number of desired output channels.

As previously described, the result can be listened to using a multi-channel or a monophonic loudspeaker system.

Figure 4:
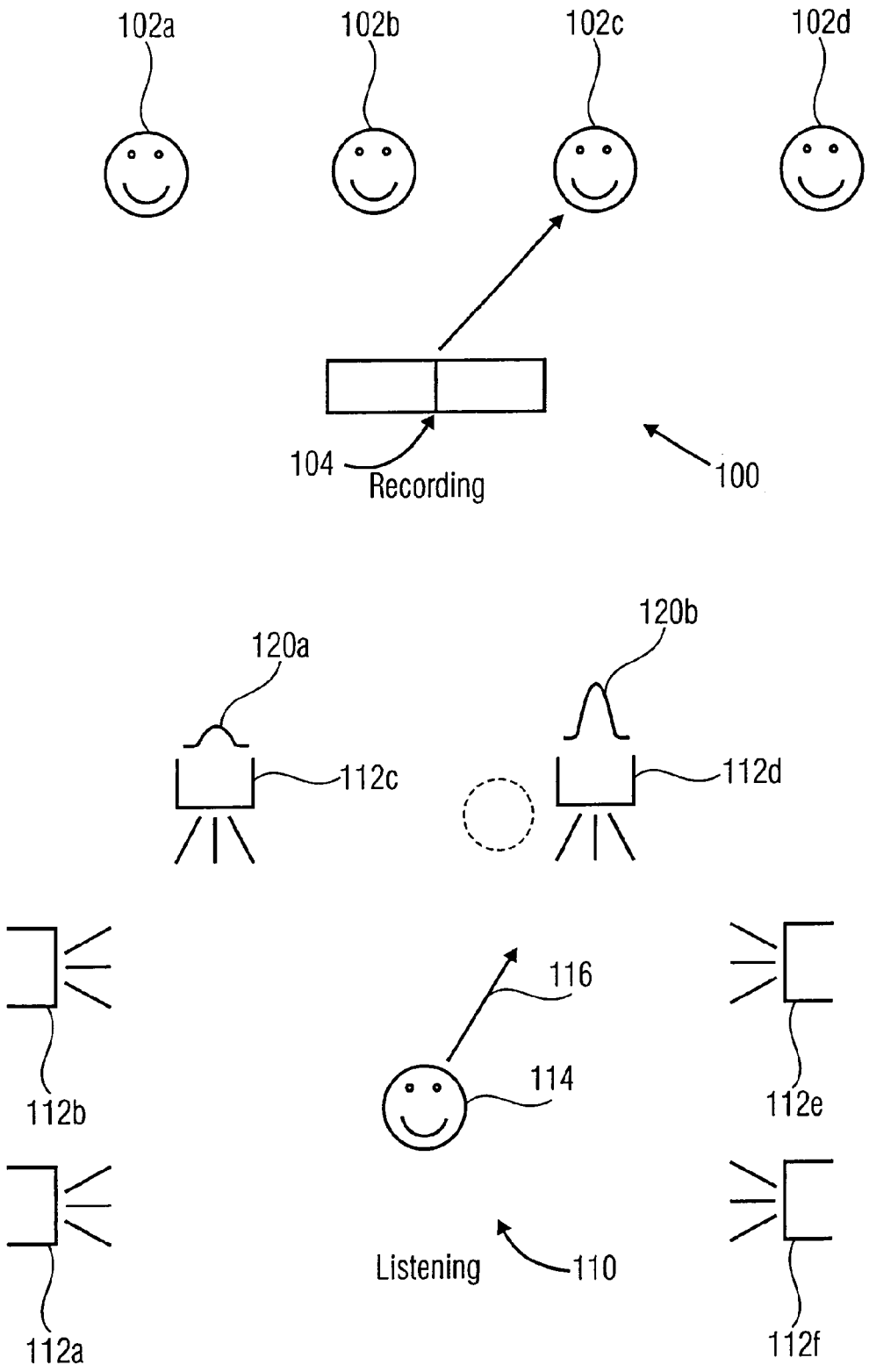
FIG. 4 shows an example of the application of an inventive method or an inventive apparatus in a teleconferencing scenario.

FIG. 4 shows an illustration as to how the inventive methods and apparatuses may be utilized to strongly increase the perceptibility of a participant within in a teleconferencing scenario. On the recording side 100, four talkers 102*a*-102*d* are illustrated which have a distinct orientation with respect to a recording position 104. That is, an audio signal originating from talker 102*c* has a fixed direction of origin with respect to the recording position 104. Assuming the audio signal recorded at recording position 104 has a contribution from talker 102*c* and some "background" noise originating, for example, from a discussion of talkers 102*a* and 102*b*, a broadband signal recorded and transmitted to a listening site 110 will comprise both signal components.

As an example, a listening set-up having six loudspeakers 112*a*-112*f* is sketched which surround a listener located at a listening position 114. Therefore, in principle, sound emanating from almost arbitrary positions around the listener 114 can be reproduced by the set-up sketched in FIG. 4. Conventional multi-channel systems would reproduce the sound using these six speakers 112*a*-112*f* to reconstruct the spatial perception experienced at the recording position 104 during recording as closely as possible. Therefore, when the sound is reproduced using conventional techniques, also the contribution of talker 102*c* as the "background" of the discussing talkers 102*a* and 102*b* would be clearly audible, decreasing the intelligibility of the signal of talker 102*c*.

According to an embodiment of the present invention, a direction selector can be used to select a desired direction of origin with respect to the recording position which is used for a reconstructed version of a reconstructed audio signal which is to be played back by the loudspeakers 112*a*-112*f*. Therefore, a listener 114 can select the desired direction 116, corresponding to the position of talker 102*c*. Thus, the audio portion modifier can modify the portion of the audio channel to derive the reconstructed portion of the reconstructed audio signal such that the intensity of the portions of the audio channel originating from a direction close to the selected direction 116 are emphasized. The listener may, at the receiving end, decide which direction of origin shall be reproduced. Having made this selection, only those signal portions are emphasized which originate from the direction of talker 102*c* and thus, the discussing talkers 102*a* and 102*b* will become less disturbing. Apart from emphasizing the signal from the selected direction, the direction may be reproduced by amplitude panning, as symbolically indicated by wave forms 120*a* and 120*b*. As talkers 102*c* would be located closer to loudspeaker 112*d* than to loudspeaker 112*c*, amplitude panning will lead to a reproduction of the emphasized signal via loudspeakers 112*c* and 112*d*, whereas the remaining loudspeakers will be nearly quiet (eventually playing back diffuse signal portions). Amplitude panning will increase the level of loudspeaker 112*d* with respect to loudspeaker 112*c*, as talker 102*c* is located closer to loudspeaker 112*d*.

Figure 5:
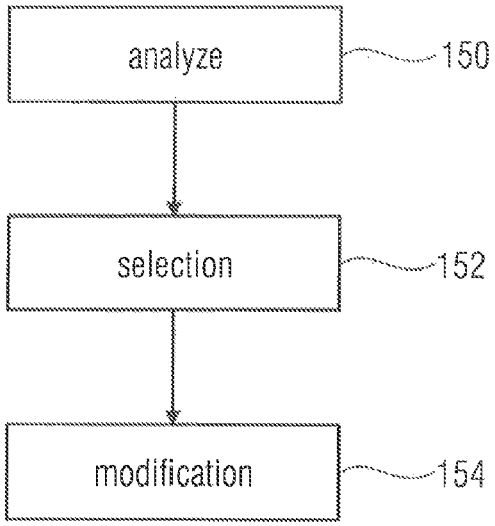
FIG. 5 shows an embodiment of a method for enhancing a directional perception of an audio signal.

FIG. 5 illustrates a block diagram of an embodiment of a method for enhancing a directional perception of an audio signal. In a first analysis step 150, at least one audio channel and associated direction parameters indicating a direction of origin of a portion of the audio channel with respect to a recording position are derived.

In a selection step 152, a desired direction of origin with respect to the recording position is selected for a reconstructed portion of the reconstructed audio signal, the reconstructed portion corresponding to a portion of the audio channel.

In a modification step 154, the portion of the audio channel is modified to derive the reconstructed portion of the reconstructed audio signal, wherein the modification comprises increasing an intensity of a portion of the audio channel having direction parameters indicating a direction of origin close to the desired direction of origin with respect to another portion of the audio channel, having direction parameters indicating a direction of origin further away from the desired direction of origin.

Figure 6:
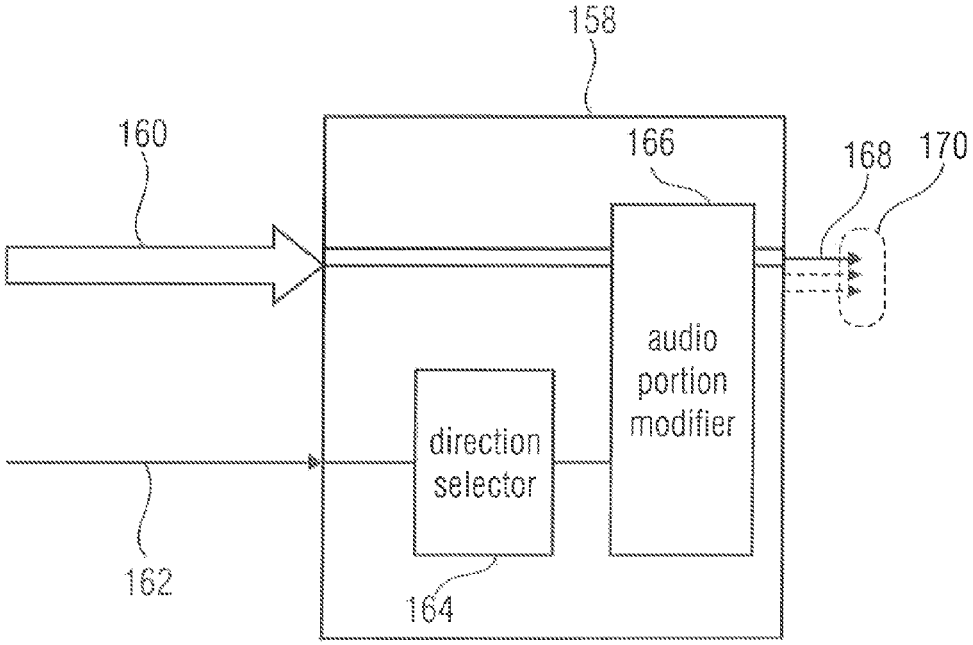
FIG. 6 shows an embodiment of a decoder for reconstructing an audio signal.

FIG. 6 illustrates an embodiment of an audio decoder for reconstructing an audio signal having at least one audio channel 160 and associated direction parameters 162 indicating a direction of origin of a portion of the audio channel with respect to a recording position.

The audio decoder 158 comprises a direction selector 164 for selecting a desired direction of origin with respect to the recording position for a reconstructed portion of the reconstructed audio signal, the reconstructed portion corresponding to a portion of the audio channel. The decoder 158 further comprises an audio portion modifier 166 for modifying the portion of the audio channel for deriving the reconstructed portion of the reconstructed audio signal, wherein the modification comprises increasing an intensity of a portion of the audio channel having direction parameters indicating a direction of origin close to the desired direction of origin with respect to another portion of the audio channel having direction parameters indicating a direction of origin further away from the desired direction of origin.

Figure 7:
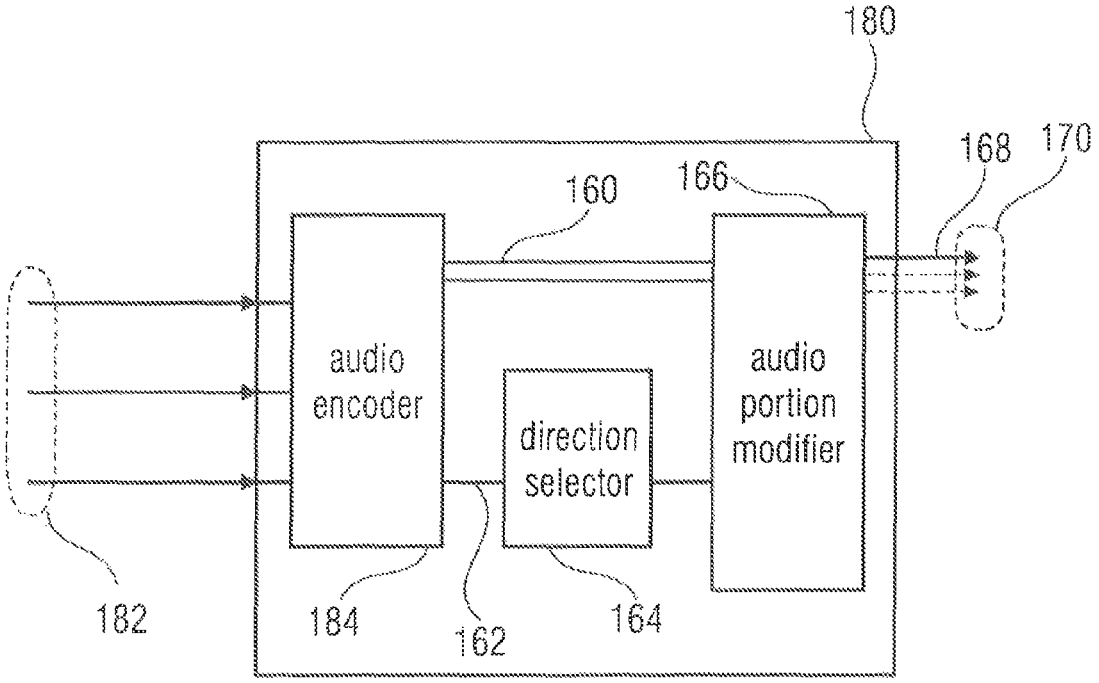
FIG. 7 shows an embodiment of a system for enhancing a directional perception of an audio signal.

As indicated in FIG. 6, a single reconstructed portion 168 may be derived or multiple reconstructed portions 170 may simultaneously be derived, when the decoder is used in a multi-channel reproduction set-up. The embodiment of a system for enhancement of a directional perception of an audio signal 180, as shown in FIG. 7 is based on decoder 158 of FIG. 6. Therefore, in the following, only the additionally introduced elements will be described. The system for enhancement of a directional perception of an audio signal 180 receives an audio signal 182 as an input, which may be a monophonic signal or a multi-channel signal recorded by multiple microphones. An audio encoder 184 derives an audio signal having at least one audio channel 160 and associated direction parameters 162 indicating a direction of origin of a portion of the audio channel with respect to a recording position. The at least one audio channel and the associated direction parameters are, furthermore, processed as already described for the audio decoder of FIG. 6, to derive a perceptually enhanced output signal 170.

Although the invention has been described mainly in the field of multi-channel audio reproduction, different fields of application can profit from the inventive methods and apparatuses. As an example, the inventive concept may be used to focus (by boosting or attenuating) on specific individuals speaking in a teleconferencing scenario. It can be furthermore used to reject (or amplify) ambient components as well as for de-reverberation or reverberation enhancement. Further possible application scenarios comprise noise canceling of ambient noise signals. A further possible use could be the directional enhancement for signals of hearing aids.

Depending on certain implementation requirements of the inventive methods, the inventive methods can be implemented in hardware or in software. The implementation can be performed using a digital storage medium, in particular a disk, DVD or a CD having electronically readable control signals stored thereon, which cooperate with a programmable computer system such that the inventive methods are performed. Generally, the present invention is, therefore, a computer program product with a program code stored on a machine readable carrier, the program code being operative for performing the inventive methods when the computer program product runs on a computer. In other words, the inventive methods are, therefore, a computer program having a program code for performing at least one of the inventive methods when the computer program runs on a computer.

While the foregoing has been particularly shown and described with reference to particular embodiments thereof, it will be understood by those skilled in the art that various other changes in the form and details may be made without departing from the spirit and scope thereof. It is to be understood that various changes may be made in adapting to different embodiments without departing from the broader concepts disclosed herein and comprehended by the claims that follow.

While this invention has been described in terms of several embodiments, there are alterations, permutations, and equivalents which fall within the scope of this invention. It should also be noted that there are many alternative ways of implementing the methods and compositions of the present invention. It is therefore intended that the following appended claims be interpreted as including all such alterations, permutations and equivalents as fall within the true spirit and scope of the present invention.

the invention claimed is:

1. A method for reconstructing an audio signal to obtain a reconstructed audio signal, the method comprising:

receiving the audio signal, the audio signal comprising at least one audio channel and a first associated direction parameter indicating a first direction of origin of a first portion in a first frequency band of a frame of the at least one audio channel with respect to a recording position and a second associated direction parameter indicating a second direction of origin of a second portion in a second frequency band of the frame of the at least one audio channel with respect to the recording position, wherein the first associated direction parameter is different from the second associated direction parameter, wherein the first direction of origin is different from the second direction of origin, and wherein the first frequency band is different from the second frequency band;

selecting, by a selector, a set direction of origin with respect to the recording position to obtain a selected set direction of origin; and modifying, by a modifier, the first portion in the first frequency band of the frame of the at least one audio channel and the second portion in the second frequency band of the frame of the at least one audio channel for deriving a reconstructed portion in the first frequency band and the second frequency band of the reconstructed audio signal for the frame of the at least one audio channel, wherein the modifying comprises increasing an intensity of the first portion in the first frequency band of the frame of the at least one audio channel, when the first direction parameter associated with the first frequency band of the first portion of the at least one audio channel indicates the first direction of origin close to the selected set direction of origin with respect to the second frequency band of the second portion of the frame of the at least one audio channel for which the second associated direction parameter indicates the second direction of origin further away from the selected set direction of origin, wherein at least one of the selector and the modifier comprises a hardware implementation.

2. The method of claim 1, wherein the selecting comprises: reading the set direction from a memory.

3. The method of claim 1, in which the modifying comprises deriving a scaling factor for the first and the second portions of the at least one audio channel such that a scaled first portion of the at least one audio channel comprising the first associated direction parameter indicating the first direction of origin close to the set direction of origin comprises an increased intensity with respect to a second scaled portion of the at least one audio channel comprising the second associated direction parameter indicating the second direction of origin further away from the set direction of origin, wherein the first scaled portion is derived by multiplying the first portion of the at least one audio channel with the first scaling factor, and wherein the second scaled portion is derived by multiplying the second portion of the at least one audio channel with the second scaling factor.

4. The method of claim 1, further comprising:

deriving a frequency representation of the frame of the at least one audio channel to obtain the first portion and the second portion having the first and the second frequency bands, respectively.

5. The method of claim 4, wherein the first frequency band has a first bandwidth, wherein the second frequency band has a second bandwidth, and wherein the first bandwidth is different from the second bandwidth.

6. The method of claim 1, wherein selecting of the set direction of origin comprises receiving input parameters indicating the set direction as a user input.

7. The method of claim 1, wherein selecting the set direction comprises receiving direction parameters associated to the audio signal, the direction parameters indicating the set direction.

8. The method of claim 1, wherein selecting the set direction comprises determining the direction of origin of a finite width frequency interval of the at least one audio channel.

9. The method of claim 1, further comprising:

receiving a first diffuseness parameter associated to the at least one audio channel and a second diffuseness parameter associated to the at least one audio channel, the first diffuseness parameter indicating a first diffuseness of the first portion of the at least one audio channel, and the second diffuseness parameter indicating a second diffuseness of the second portion of the at least one audio channel, the second diffuseness being different from the first diffuseness; and wherein the modifying of the first or second portion of the at least one audio channel comprises decreasing an intensity of the first portion of the at least one audio channel comprising the first diffuseness parameter indicating the first diffuseness with respect to the second portion of the at least one audio channel comprising the second diffuseness parameter indicating the second diffuseness, the second diffuseness being lower than the first diffuseness.

10. The method of claim 1, further comprising:

up-mixing the at least one audio channel to multiple channels for playback via a loudspeaker system comprising multiple loudspeakers, wherein each of the multiple channels comprises a channel portion corresponding to the first portion of the at least one audio channel and to the second portion of the at least one audio channel.

11. The method of claim 10, in which the modifying comprises increasing the intensity of each of up-mixed first channel portions up-mixed from the first portion of the at least one audio channel comprising the first associated direction parameter indicating the first direction of origin being close to the set direction of origin with respect to up-mixed second channel portions of the multiple channels up-mixed from the second portion of the at least one audio channel comprising the second associated direction parameter indicating the second direction of origin further away from the set direction of origin.

12. The method of claim 11, further comprising:

panning the amplitude of the up-mixed first and second channel portions such that a perceived direction of origin of reconstructed first and second channel portions corresponds to the direction of origin when played back using a predetermined loudspeaker set-up.

13. A method for enhancing a directional perception of an audio signal, the method comprising:

deriving, by a signal generator, at least one audio channel and a first associated direction parameter indicating a first direction of origin of a first portion in a first frequency band of a frame of the at least one audio channel with respect to a recording position, and a second associated direction parameter indicating a second direction of origin of a second portion in a second frequency band of the frame of the at least one audio channel with respect to the recording position, wherein the first associated direction parameter is different from the second associated direction parameter, wherein the first direction of origin is different from the second direction of origin, and wherein the first frequency band is different from the second frequency band;

selecting, by a selector, a set direction of origin with respect to the recording position to obtain a selected set direction of origin; and modifying, by a modifier, the first portion in the first frequency band of the frame of the at least one audio channel and the second portion in the second frequency band of the frame of the at least one audio channel for deriving a reconstructed portion in the first frequency band and the second frequency band of the reconstructed audio signal for the frame of the at least one audio channel, wherein the modifying comprises increasing an intensity of the first portion in the first frequency band of the frame of the at least one audio channel, when the first direction parameter associated with the first frequency band of the first portion of the at least one audio channel indicates the first direction of origin close to the selected set direction of origin with respect to the second frequency band of the second portion of the frame of the at least one audio channel for which the second associated direction parameter indicates the second direction of origin further away from the selected set direction of origin, wherein at least one of the signal generator, the selector and the modifier comprises a hardware implementation.

14. An audio decoder apparatus for reconstructing an audio signal to obtain a reconstructed audio signal, comprising:

an input adapted to receive the audio signal, the audio signal comprising at least one audio channel and a first associated direction parameter indicating a first direction of origin of a first portion in a first frequency band of a frame of the at least one audio channel with respect to a recording position, and a second associated direction parameter indicating a second direction of origin of a second portion in a second frequency band of the frame of the at least one audio channel with respect to the recording position, wherein the first associated direction parameter is different from the second associated direction parameter, wherein the first direction of origin is different from the second direction of origin, and wherein the first frequency band is different from the second frequency band;

a direction selector adapted to select a set direction of origin with respect to the recording position to obtain a selected set direction of origin; and an audio portion modifier configured for modifying the first portion in the first frequency band of the frame of the at least one audio channel and the second portion in the second frequency band of the frame of the at least one audio channel for deriving a reconstructed portion in the first frequency band and the second frequency band of the reconstructed audio signal for the frame of the at least one audio channel, wherein the modifying comprises increasing an intensity of the first portion in the first frequency band of the frame of the at least one audio channel, when the first direction parameter associated with the first frequency band of the first portion of the at least one audio channel indicates the first direction of origin close to the selected set direction of origin with respect to the second frequency band of the second portion of the frame of the at least one audio channel for which the second associated direction parameter indicates the second direction of origin further away from the selected set direction of origin, wherein at least one of the input, the direction selector and the audio portion modifier comprises a hardware implementation.

15. An audio encoder apparatus for enhancing a directional perception of an audio signal, the audio encoder comprising:

a signal generator adapted to derive at least one audio channel and a first associated direction parameter indicating a first direction of origin of a first portion in a first frequency band of a frame of the at least one audio channel with respect to a recording position, and a second associated direction parameter indicating a second direction of origin of a second portion in a second frequency band of the frame of the at least one audio channel with respect to the recording position, wherein the first associated direction parameter is different from the second associated direction parameter, wherein the first direction of origin is different from the second direction of origin, and wherein the first frequency band is different from the second frequency band;

a direction selector adapted to select a set direction of origin with respect to the recording position to obtain a selected set direction of origin; and a signal modifier configured for modifying the first portion in the first frequency band of the frame of the at least one audio channel and the second portion in the second frequency band of the frame of the at least one audio channel for deriving a reconstructed portion in the first frequency band and the second frequency band of the reconstructed audio signal for the frame of the at least one audio channel, wherein the modifying comprises increasing an intensity of the first portion in the first frequency band of the frame of the at least one audio channel, when the first direction parameter associated with the first frequency band of the first portion of the at least one audio channel indicates the first direction of origin close to the selected set direction of origin with respect to the second frequency band of the second portion of the frame of the at least one audio channel for which the second associated direction parameter indicates the second direction of origin further away from the selected set direction of origin, wherein at least one of the signal generator, the direction selector and the signal modifier comprises a hardware implementation.

16. A system for enhancement of a reconstructed audio signal, the system comprising:

an audio encoder adapted to derive an audio signal comprising at least one audio channel and a first associated direction parameter indicating a first direction of origin of a first portion in a first frequency band of a frame of the at least one audio channel with respect to a recording position, and a second associated direction parameter indicating a second direction of origin of a second portion in a second frequency band of the frame of the at least one audio channel with respect to the recording position, wherein the first associated direction parameter is different from the second associated direction parameter, wherein the first direction of origin is different from the second direction of origin, and wherein the first frequency band is different from the second frequency band;

a direction selector adapted to select a set direction of origin with respect to the recording position to obtain a selected set direction of origin; and an audio decoder comprising an audio portion modifier configured for modifying the first portion in the first frequency band of the frame of the at least one audio channel and the second portion in the second frequency band of the frame of the at least one audio channel for deriving a reconstructed portion in the first frequency band and the second frequency band of the reconstructed audio signal for the frame of the at least one audio channel, wherein the modifying comprises increasing an intensity of the first portion in the first frequency band of the frame of the at least one audio channel, when the first direction parameter associated with the first frequency band of the first portion of the at least one audio channel indicates the first direction of origin close to the selected set direction of origin with respect to the second frequency band of the second portion of the frame of the at least one audio channel for which the second associated direction parameter indicates the second direction of origin further away from the selected set direction of origin, wherein at least one of the audio encoder, the direction selector, the audio decoder, and the audio portion modifier comprises a hardware implementation.

17. A non-transitory storage medium having stored thereon a computer program for, when running on a computer, implementing a method for reconstructing an audio signal to obtain a reconstructed audio signal, the method comprising:

receiving the audio signal, the audio signal comprising at least one audio channel and a first associated direction parameter indicating a first direction of origin of a first portion in a first frequency band of a frame of the at least one audio channel with respect to a recording position, and a second associated direction parameter indicating a second direction of origin of a second portion in a second frequency band of the frame of the at least one audio channel with respect to the recording position, wherein the first associated direction parameter is different from the second associated direction parameter, wherein the first direction of origin is different from the second direction of origin, and wherein the first frequency band is different from the second frequency band;

selecting a set direction of origin with respect to the recording position to obtain a selected set direction of origin; and modifying the first portion in the first frequency band of the frame of the at least one audio channel and the second portion in the second frequency band of the frame of the at least one audio channel for deriving a reconstructed portion in the first frequency band and the second frequency band of the reconstructed audio signal for the frame of the at least one audio channel, wherein the modifying comprises increasing an intensity of the first portion in the first frequency band of the frame of the at least one audio channel, when the first direction parameter associated with the first frequency band of the first portion of the at least one audio channel indicates the first direction of origin close to the selected set direction of origin with respect to the second frequency band of the second portion of the frame of the at least one audio channel for which the second associated direction parameter indicates the second direction of origin further away from the selected set direction of origin.

18. A non-transitory storage medium having stored thereon a computer program for, when running on a computer, implementing a method for enhancing a directional perception of an audio signal, the method comprising:

deriving at least one audio channel and associated direction parameters indicating a first direction of origin of a first portion in a first frequency band of a frame of the at least one audio channel with respect to a recording position, and a second associated direction parameter indicating a second direction of origin of a second portion in a second frequency band of the frame of the at least one audio channel with respect to the recording position, wherein the first associated direction parameter is different from the second associated direction parameter, wherein the first direction of origin is different from the second direction of origin, and wherein the first frequency band is different from the second frequency band;

selecting a set direction of origin with respect to the recording position to obtain a selected set direction of origin; and modifying the first portion in the first frequency band of the frame of the at least one audio channel and the second portion in the second frequency band of the frame of the at least one audio channel for deriving a reconstructed portion in the first frequency band and the second frequency band of the reconstructed audio signal for the frame of the at least one audio channel, wherein the modifying comprises increasing an intensity of the first portion in the first frequency band of the frame of the at least one audio channel, when the first direction parameter associated with the first frequency band of the first portion of the at least one audio channel indicates the first direction of origin close to the selected set direction of origin with respect to the second frequency band of the second portion of the frame of the at least one audio channel for which the second associated direction parameter indicates the second direction of origin further away from the selected set direction of origin.

* * * * *